US007896686B2

(12) United States Patent
Hoppe

(10) Patent No.: US 7,896,686 B2
(45) Date of Patent: Mar. 1, 2011

(54) ELECTRICAL CONNECTION CLAMP OR TERMINAL CLAMP

(75) Inventor: Udo Hoppe, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 97 days.

(21) Appl. No.: 12/514,925

(22) PCT Filed: May 21, 2008

(86) PCT No.: PCT/EP2008/004066

§ 371 (c)(1),
(2), (4) Date: May 14, 2009

(87) PCT Pub. No.: WO2008/145291

PCT Pub. Date: Dec. 4, 2008

(65) Prior Publication Data

US 2010/0081346 A1 Apr. 1, 2010

(30) Foreign Application Priority Data

May 25, 2007 (DE) ..... 10 2007 024 690

(51) Int. Cl.
*H01R 11/22* (2006.01)

(52) U.S. Cl. ..... 439/441

(58) Field of Classification Search ..... 439/441, 439/435, 422, 835, 822; 174/68.2
See application file for complete search history.

(56) References Cited

U.S. PATENT DOCUMENTS

| | | | | |
|---|---|---|---|---|
| 4,768,981 | A * | 9/1988 | Hohorst | 439/835 |
| 4,978,315 | A * | 12/1990 | Edgley et al. | 439/441 |
| 5,975,940 | A | 11/1999 | Hartmann et al. | |
| 6,074,242 | A * | 6/2000 | Stefaniu et al. | 439/441 |
| 6,336,824 | B1 * | 1/2002 | Sorig | 439/441 |
| 6,786,779 | B2 * | 9/2004 | Feldmeier et al. | 439/729 |
| 6,814,608 | B2 * | 11/2004 | Kollmann | 439/441 |
| 6,893,286 | B2 * | 5/2005 | Drewes et al. | 439/441 |
| 6,911,602 | B2 * | 6/2005 | Conrad | 174/68.2 |
| 7,083,463 | B2 * | 8/2006 | Steinkemper et al. | 439/441 |
| 7,238,043 | B2 * | 7/2007 | Reibke et al. | 439/441 |

FOREIGN PATENT DOCUMENTS

| | | |
|---|---|---|
| DE | 197 11 051 A1 | 9/1998 |
| DE | 198 02 945 A1 | 7/1999 |
| DE | 202 10 105 U1 | 11/2002 |
| DE | 203 12 861 U1 | 12/2003 |
| EP | 1 515 397 A1 | 3/2005 |

* cited by examiner

*Primary Examiner*—Alexander Gilman
(74) *Attorney, Agent, or Firm*—Roberts Mlotkowski Safran & Cole, P.C.; David S. Safran

(57) ABSTRACT

An electric connection clamp or terminal clamp for connecting a terminal conductor has a clamp spring and a metal part. The clamp spring has a clamp limb and a contact limb, a recess for introducing the electric conductor being formed in said contact limb. The clamp limb and the contact limb are curved in such a manner that the end of the clamp limb penetrates through the recess. The end of the clamp limb and the contact limb form a spring force clamping connection for the conductor that is to be connected. The ends of the limbs each have a securing section and the securing section of the contact limb extends counter to the direction of introduction of the conductor through the recess.

10 Claims, 3 Drawing Sheets

ELECTRICAL CONNECTION CLAMP OR TERMINAL CLAMP

BACKGROUND OF THE INVENTION

1. Field of Invention

The invention relates to an electrical connection clamp or terminal clamp for connecting an electrical conductor, with a clamp spring and with a metal part, the clamp spring having one clamp leg and one contact leg, in the clamp leg a recess for insertion of the electrical conductor which is to be connected being made, the clamp leg and the contact leg of the clamp spring being bent to one another such that the end of the clamp leg is inserted through a recess, on the end of the recess which is away from the end of the clamp leg a retaining section being punched out of the contact leg and being bent in the insertion direction of the electrical conductor which is to be connected, the metal part having a contact leg, an opposite retaining leg and a bridge which connects the legs, the end of the clamp leg of the clamp spring and the contact leg of the metal part forming a spring force terminal connection for the electrical conductor to be connected, and the ends of the legs each having an attachment section and the attachment section of the contact leg opposite the insertion direction of the electrical conductor to be connected extending through the recess.

2. Description of Related Art

German Patent Application DE 196 54 611 A1 and corresponding U.S. Pat. No. 5,975,940 discloses an electrical terminal clamp which has a U-shaped, open clamp spring and a conductor bar piece which is made as a corner angle. The conductor bar piece has a retaining leg which is located perpendicular to the conductor insertion, direction and a contact leg, in the retaining leg a rectangular opening being formed through which the electrical conductor to be connected can be inserted. The U-shaped clamp spring is inserted with the ends of its two legs in the opening and held such that the backward arc of the clamp spring in the conductor insertion direction is located in front of the opening and the clamp leg of the clamp spring presses an inserted electrical conductor against the contact leg so that the clamp spring and the conductor bar piece form a spring force terminal connection.

Similar electrical connection clamps with an essentially U-shaped clamp spring and a metal part are also known from German Utility Models DE 203 12 861 U1 and DE 202 10 105 U1. It is common to all these known connection clamps that the clamp spring with the ends of its two legs is inserted in an opening of the metal part so that when the clamp spring is opened there is the danger that the clamp spring will slip.

In addition, loop-shaped clamp springs for electrical connection clamps or terminal clamps are also known from the prior art, for example German Patent Application DE 197 11 051 A1 or German Patent DE 198 02 945 C2, specifically as so-called tension springs in tension spring clamps. Tension spring clamps have become established on the market over time in addition to screw clamps and are used in the millions, especially as terminal blocks. The advantage of tension spring clamps compared to screw clamps consists in that the tension spring clamps enable quicker and simpler wiring. For actuating the tension spring clamp only one actuating tool is needed, for example a screwdriver, which is inserted into an actuating shaft to open the clamp. In doing so, the tip of the screwdriver tensions the tension spring, by which the clamp site is opened. A conductor which is to be connected can be inserted through the recess in the clamp leg. After removing the screwdriver, the conductor is pulled by the lower edge of the recess against a conductor bar which is connected to the tension spring and thus makes electrical contact.

The known tension spring clamps however clearly differ in their configuration and in their function from the initially described connection clamp or terminal clamp. In the known loop-shaped tension springs, corresponding to their name, the conductor to be connected is pulled by the clamp leg against the conductor bar. In contrast, in the above described connection clamps or terminal clamps the conductor to be connected is pressed by the clamp leg against a region of the metal part.

The initially described electrical connection clamp or terminal clamp underlying the invention is known from German Patent Application DE 10 2004 046 471 B3. In this known connection clamp, the clamp spring however is not made U-shaped—as in the terminal clamp known from German Patent Application DE 196 54 611 A 1—but loop-shaped, in the contact leg of the clamp spring which is located not parallel, but essentially perpendicular to the insertion direction of the electrical conductor to be connected, there being a recess for inserting an electrical conductor which is to be connected. The clamp leg and the contact leg of the clamp spring are bent to one another such that the end of the clamp leg is inserted through the recess.

In the known connection clamp or terminal clamp, the fixing of the clamp spring and metal part takes place by the clamp spring with its recess being slipped onto the metal part. To attach the clamp spring relative to the metal part, for this purpose, two attachment sections are provided on the metal part, both of which are inserted through the recess opposite the insertion direction of the electrical conductor to be connected. To mount the clamp spring on the metal part, thus, the contact leg with its recess is inserted over the two attachment sections of the metal part so that the recess extends around the two attachment sections in the manner of a frame. In addition, on the end of the recess away from the end of the clamp leg, a retaining section is punched out of the contact leg of the clamp spring and is bent essentially perpendicular to the contact leg and extends behind the attachment section of the retaining leg from the outside.

But, for this terminal clamp, there is also the danger of the clamp spring being detached or lifted off from the metal part. This danger exists especially when the clamp spring is actuated, i.e., when a conductor is inserted into the clamp site or when the clamp spring is opened since the clamp spring can tilt so that only the attachment section of the contact leg extends through the recess. The danger that it slips when the clamp spring is being opened prevails especially when the clamp spring is not held in its position by the housing which surrounds it.

SUMMARY OF THE INVENTION

Therefore, the object of this invention is to further improve the fixing of the clamp spring and metal part in the initially described connection clamp or terminal clamp.

This object is achieved in accordance with the invention in the initially described electrical connection clamp or terminal clamp in that the attachment section of the retaining leg adjoins the outer side of the retaining section of the contact leg, which outer side faces away from the recess. In contrast to the electrical connection clamp known from German Patent Application DE 10 2004 046 471 B3 and corresponding U.S. Pat. No. 7,238,043, in the connection clamp or terminal clamp in accordance with the invention, it is not the retaining section of the contact leg which extends behind the attachment section of the retaining leg, but it is the attachment section which extends around the retaining section. In this way, tilting of the clamp spring is also prevented when the clamp site is being opened, since the retaining section of the contact leg can be released from the "clamped" contact position on the attachment section of the retaining leg only by applying a force.

Moreover, it is preferably provided that a catch projection is formed on the attachment section of the retaining leg and in the retaining section of the contact leg an opening is formed so that, in the mounted state of the clamp spring and metal part, the catch projection engages the opening and thus additionally fixes the location of the clamp spring. The catch projection preferably has a bevel so that locking of the catch projection is enabled with little expenditure of force, while a greater force is necessary to release the catch connection.

The fixing of the clamp spring on the metal part is preferably further enhanced by the clamp spring, in the mounted state, being clamped between the attachment sections of the contact leg and of the retaining leg in the manner of a force fit. For this purpose, in the mounted state of the clamp spring and metal part, the end of the clamp leg of the clamp spring adjoins the contact leg of the metal part such that the retaining section of the contact leg is pressed against the attachment section of the retaining leg which adjoins its outer side. In the mounted state of the clamp spring and metal part, thus, the retaining section is always pressed by the spring force of the clamp spring against the attachment section of the retaining leg when an electrical conductor has not yet been inserted into the clamp site. When the clamp spring is actuated, the contact pressure force is even further increased so that unintentional tilting of the clamp spring and thus detachment of the clamp spring from the metal part cannot take place.

According to another advantageous embodiment of the connection clamp or terminal clamp in accordance with the invention, the proper location of the clamp spring on the metal part is additionally ensured by preferably two stops being formed on the end of the retaining leg and being located laterally spaced apart from the attachment section of the retaining leg. In the mounted state of the clamp spring and metal part then the contact leg of the clamp spring can adjoin the stops so that tilting of the clamp spring in the direction of the metal part is also prevented. The clamp spring is thus fixed reliably in its given position on one side by the attachment section of the contact leg which extends through the recess and on the other side by the attachment section and the stops of the contact leg.

According to another advantageous configuration of the invention, the attachment section of the contact leg is bent such that the attachment section together with the end of the clamp leg of the clamp spring forms an entry funnel for the electrical conductor which is to be connected. The execution of the entry funnel thus correctly and automatically positions the tip of the electrical conductor to be connected so that simple and exact connection of an electrical conductor to the electrical connection clamp or terminal clamp is possible.

The electrical connection clamp or terminal clamp in accordance with the invention can be mounted directly on a circuit board, then especially the contact leg of the metal part or a plug part which is connected to the metal part being soldered to the circuit board. Preferably however, the clamp spring and the metal part are located in an insulating housing, the insulating housing having a conductor insertion opening for inserting the electrical conductor to be connected and an actuating opening for inserting an actuating tool. Additional fixing of the clamp spring and of the metal part can be implemented by the configuration of the housing. Moreover, excessively wide opening of the clamp spring, and thus destruction of the clamp spring, can be prevented by the execution of the actuating opening and the arrangement of the corresponding projections.

The execution of the actuating opening for insertion of an actuating tool, on the one hand, results in that the electrical connection clamp or terminal clamp can also be used for fine-wire flexible conductors in which opening of the clamp spring by inserting the electrical conductor is not possible. On the other hand, by opening the clamp spring using the actuating tool an already clamped electrical conductor can again be easily released from the clamp site.

According to the last advantageous configuration of the invention, a kink is formed on the clamp leg of the clamp spring which is aligned in the direction of the spring force of the clamp leg so that the tip of the actuating tool can act on the kink for opening of the clamp spring. The kink which has been made on the clamp leg enables simple action of the tip of the actuating tool on the clamp leg for opening the clamp spring. Moreover, in this way, the insertion depth of the actuating tool into the actuating opening, which depth is necessary for complete opening of the clamp spring, can be reduced.

In particular, there is now a host of possibilities for configuring and developing the electrical connection clamp or terminal clamp in accordance with the invention. For this purpose, reference is made to the following description of a preferred embodiment in conjunction with the drawings.

DETAILED DESCRIPTION OF THE INVENTION

Figure 1:
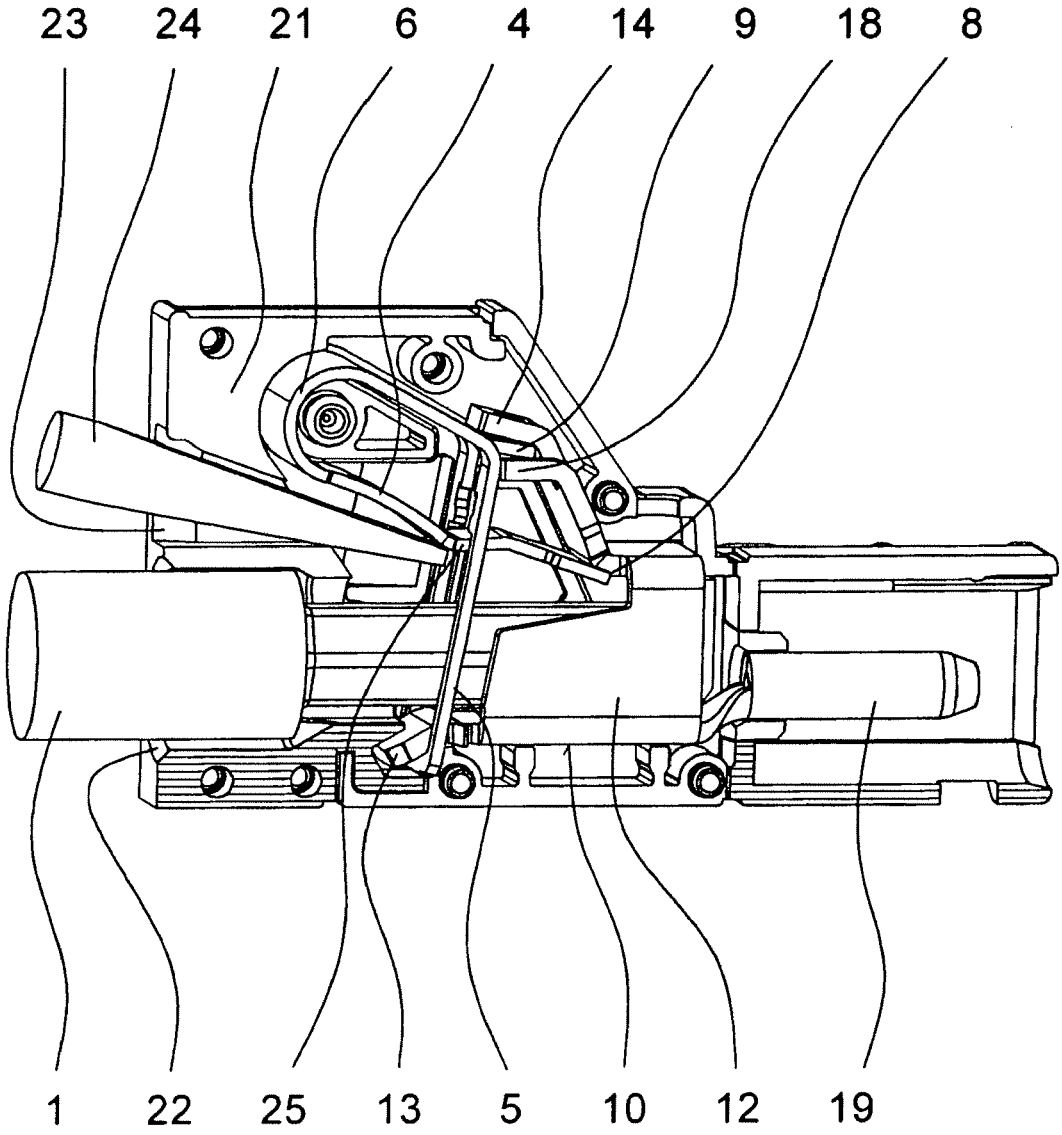
FIG. 1 shows an electrical connection clamp or terminal clamp in accordance with the invention with an electrical conductor to be connected.

The figures show a connection clamp or terminal clamp for connection of an electrical conductor 1 which is shown only in FIG. 1. Important components of the connection clamp or terminal clamp are a clamp spring 2 and a metal part 3, in FIG. 3 the clamp spring 2 and the metal part 3 being shown in the not yet mounted state.

The clamp spring 2 is comprised of a clamp leg 4, a contact leg 5 and a back 6 which connects the clamp leg 4 and the contact leg 5. As is apparent from FIG. 1, the contact leg 5 of the clamp spring 2 is aligned essentially perpendicular to the insertion direction of the electrical conductor 1 to be connected. A recess 7 is formed in the contact leg 5 for inserting the conductor 1. On the end of the recess 7 which is away from the end 8 of the clamp leg 4, a retaining section 9 is punched out of the contact leg 5 and is bent essentially perpendicular to the contact leg 5 in the insertion direction of the electrical conductor 1 to be connected.

The metal part 3 has a contact leg 10, an opposite retaining leg 11 and a bridge 12 which connects the legs 10, 11. In particular, the contact leg 10 runs essentially parallel to the insertion direction of the electrical conductor 1 which is to be connected, so that the end 8 of the clamp leg 4 of the clamp spring 2 and the contact leg 10 of the metal part 3 form a spring force terminal connection for the electrical conductor 1 which is to be connected.

For mounting the clamp spring 2 on the metal part 3, each of the ends of the two legs 10, 11 have an attachment section 13, 14. The attachment section 13 of the contact leg 10 extends opposite the insertion direction of the electrical conductor 1 to be connected through the recess 7 in the contact leg 5. In contrast, the attachment section 14 of the retaining leg 11 adjoins the outer side of the retaining section 9 facing away from the recess 7, so that the attachment section 14 does not extend through the recess 7 in the contact leg 5. In the alignment of the clamp spring 2 and metal part 3 which is shown in FIG. 2, the attachment section 14 of the retaining leg 11 thus overlaps the retaining section 9 of the contact leg 5.

Figure 2:
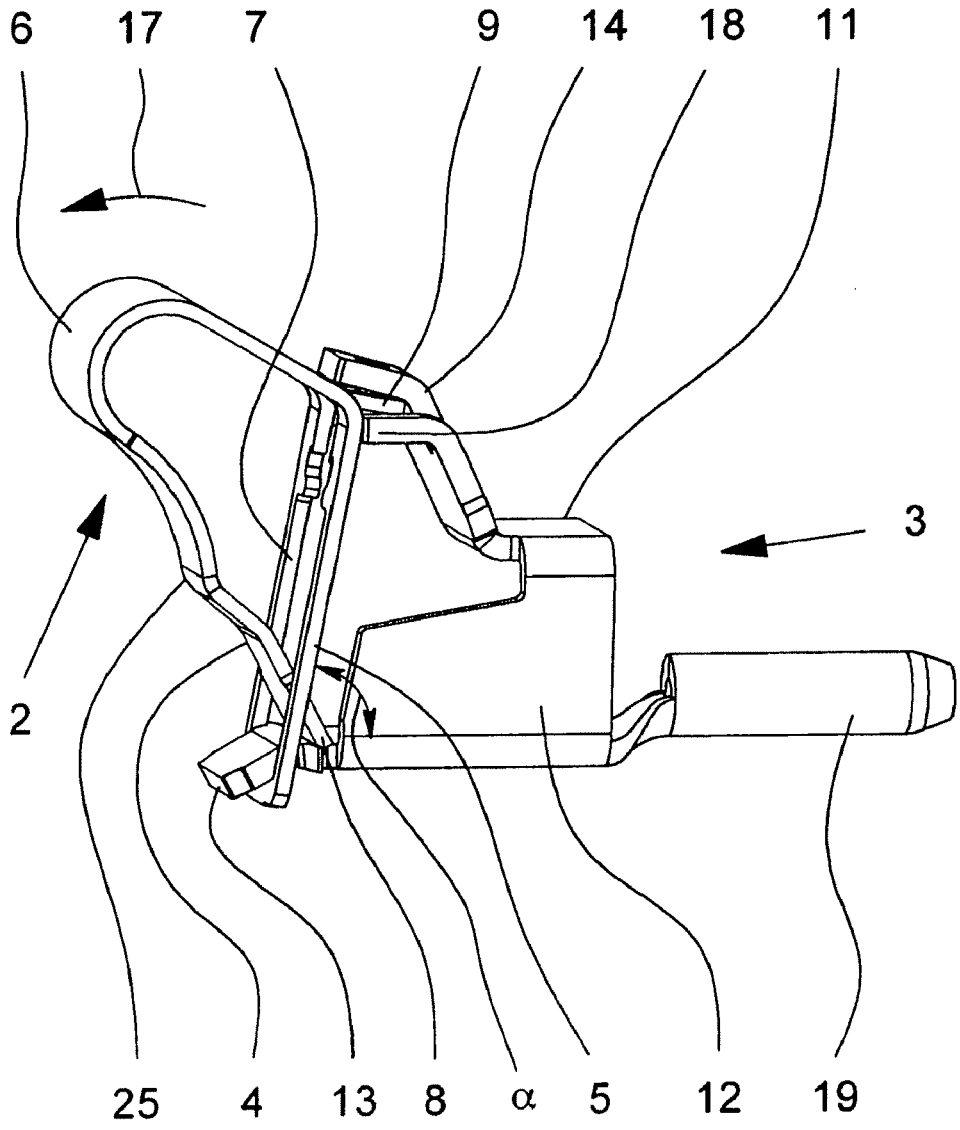
FIG. 2 shows the clamp spring and the metal part of the electrical connection clamp or terminal clamp shown in FIG. 1 without a housing which accommodates it.
Figure 3:
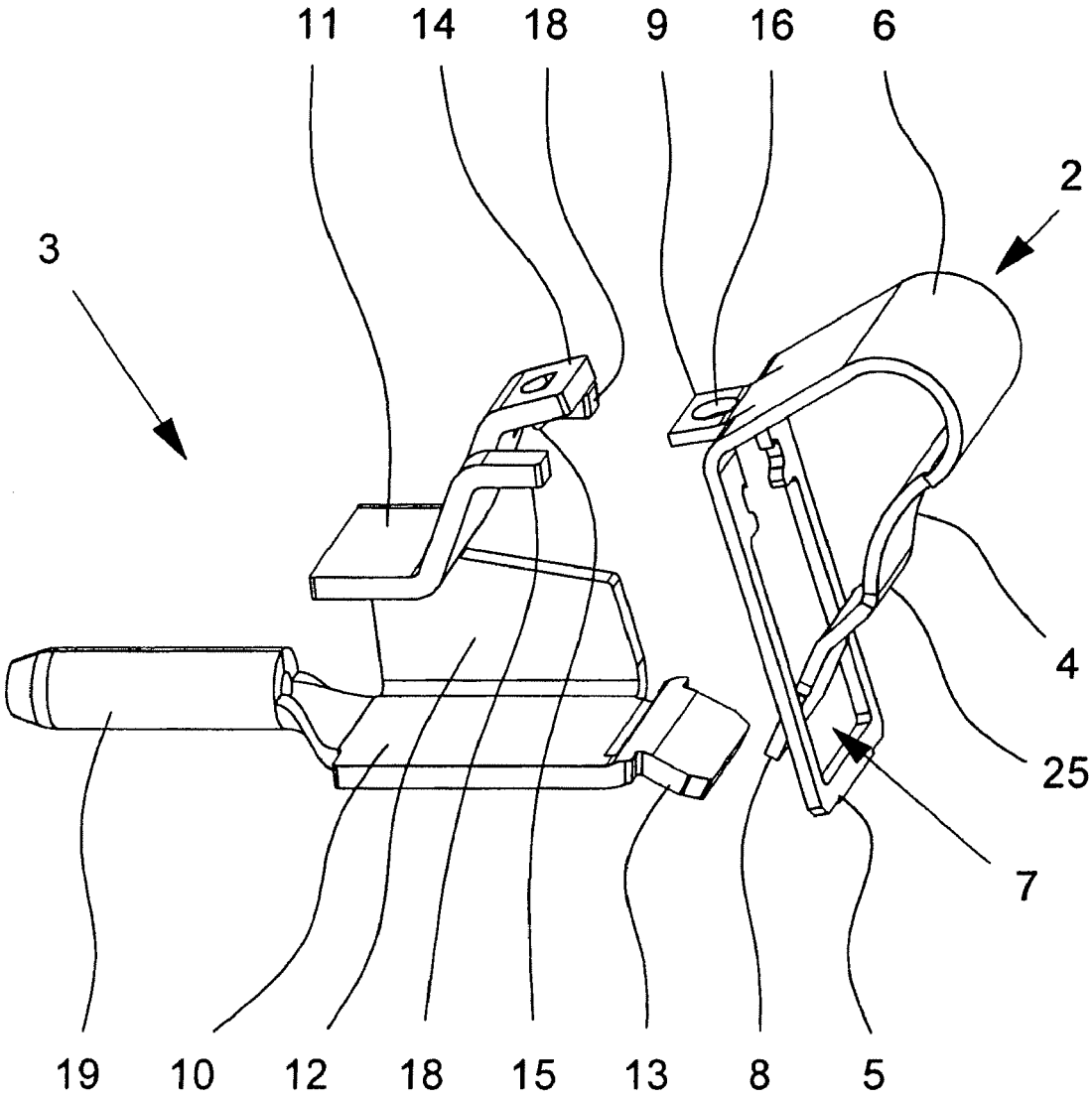
FIG. 3 is an exploded view of the clamp spring and the metal part of the electrical connection clamp or terminal clamp of FIG. 2 in the unmounted state.

As is apparent from FIG. 3, a catch projection 15 is formed on the attachment section 14 which, in the mounted state of the clamp spring 2 and metal part 3, locks from overhead into an opening 16 which is made in the retaining section 9. In this way, tilting of the clamp spring 2 in the direction of the arrow 17 shown in FIG. 2 is reliably prevented. Tilting of the clamp spring 2 opposite the direction of the arrow 17 is prevented by two stops 18 being formed on the end of the retaining leg 11 and being adjoined by the contact leg 5 of the clamp spring 2 in the correctly mounted state. In particular, FIG. 3 shows that the two stops 18 are located on the end of the retaining leg 11 laterally from the attachment section 14, the attachment section 14 and the two stops 18 being made in one piece with the retaining leg 11, specifically being bent by a punching and bending process from the retaining leg 11.

The contact leg 5 of the clamp spring 2 is located at an angle $\alpha$ less than 90°, preferably at an angle $\alpha$ of roughly 75° to 85° to the contact leg 10 of the metal part 3. By this arrangement of the clamp spring 2, on the one hand, the danger of unintentional tilting of the clamp spring 2 in the direction of the arrow 17 is further reduced, and on the other hand, the size of the electrical connection clamp or terminal clamp that is as small as possible is achieved.

In the mounted state of the clamp spring 2 and metal part 3 which is shown in FIG. 2 and in which an electrical conductor 1 has not yet been inserted into the clamp site, the end 8 of the clamp leg 4 of the clamp spring 2 is pretensioned against the contact leg 10 of the metal part 3 so that the retaining section 9 of the contact leg 5 is pressed against the attachment section 14 of the retaining leg 11 by the spring force of the clamp spring 2. In this way, unintentional tilting of the clamp spring 2 and jumping of the clamp spring 2 out of the fixing means which is formed by the catch projection 15 and the opening 16 are prevented. The clamp spring 2 is thus reliably fixed on the metal part 3 and held in its given position. The pretensioning of the end 8 of the clamp leg 4 of the clamp spring 2 against the contact leg 10 of the metal part 3 also ensures that the clamp spring 2 cannot tilt so that the attachment section 13 of the contact leg 10 no longer extends through the recess 7.

In the embodiment shown in figures, the metal part 3 has a plug part 19 which can be inserted into the corresponding sleeve of the mating plug. Alternatively, at least one solder pin can also be made on the metal part so that the electrical connection clamp can be used as a circuit board clamp for printed circuits. In this regard, the connection clamp can be mounted directly on the circuit board. Likewise the metal part can also have a socket part instead of a plug part 19.

In particular, it is apparent from FIG. 2 that the attachment section 13 of the contact leg 10 is bent such that the attachment section 13 together with the end 8 of the clamp leg 4 has an entry funnel for the electrical conductor 1 to be connected. In this way, the tip of the electrical conductor 1 to be connected is correctly and automatically positioned, by which simple and exact connection of an electrical conductor 1 to the electrical connection clamp or terminal clamp is possible.

According to the embodiment shown in FIG. 1, the clamp spring 2 and the metal part 3 are located jointly in an insulating housing 21, the insulating housing 21 having a conductor insertion opening 22 for inserting the electrical conductor 1 to be connected and an actuating opening 23 for an actuating tool 24. The actuating tool 24 can be, for example, the tip of a screwdriver. With the actuating tool 24, as shown in FIG. 1, the clamp spring 2 can be pressed onto the clamp leg 4, by which the clamp spring 2 opens so that an electrical conductor 1 can be inserted or withdrawn from the clamp spring 1 more easily. A kink 25 is formed on the clamp leg 4 which is aligned in the direction of the spring force of the clamp leg 4. The tip of the actuating tool can act on the kink 25, by which the insertion depth of the actuating tool 24 into the actuating opening 23, which depth is the maximum required for complete opening of the clamp spring 2, is reduced.

The invention claimed is:

1. Electrical connection clamp or terminal clamp for connecting an electrical conductor, comprising:

a clamp spring, the clamp spring having a clamp leg and a contact leg, a recess being formed in the clamp leg for insertion of the electrical conductor to which a connection is to be made, and a metal part having a contact leg, an opposite retaining leg and a bridge which connects the legs, wherein the clamp leg and the contact leg of the clamp spring have been bent relative to one another such that an end of the clamp leg extends through the recess, wherein a retaining section has been punched out of the contact leg on an end of the recess which is away from said end of the clamp leg and has been bent in an insertion direction of the electrical conductor which is to be connected, wherein an end of the clamp leg of the clamp spring and the contact leg of the metal part forming a spring force terminal connection for the electrical conductor to be connected wherein the ends of each of the legs of the clamp spring has an attachment section and the attachment section of the contact leg extends through said recess in a direction opposite the insertion direction of the electrical conductor to be connected, wherein the attachment section of the retaining leg adjoins an outer side of the retaining section of the contact leg, the outer side facing away from the recess.

2. Electrical connection clamp or terminal clamp as claimed in claim 1, wherein in a mounted state of the clamp spring and metal part, a catch projection formed on the attachment section of the retaining leg engages an opening in the retaining section from the outside.

3. Electrical connection clamp or terminal clamp as claimed in claim 2, wherein at least one stop is formed on the end of the retaining leg, the stop adjoining the contact leg of the clamp spring in the mounted state of the clamp spring and metal part.

4. Electrical connection clamp or terminal clamp as claimed in claim 3, wherein said at least one stop comprises two stops formed on the end of the retaining leg laterally spaced apart from the attachment section.

5. Electrical connection clamp or terminal clamp as claimed in claim 1, wherein, in a mounted state of the clamp spring and metal part, the contact leg of the clamp spring is located at an angle $\alpha$ less than 90° relative to the contact leg of the metal part.

6. Electrical connection clamp or terminal clamp as claimed in claim 1, wherein, in a mounted state of the clamp spring and metal part, the end of the clamp leg of the clamp spring adjoins the contact leg of the metal part such that the retaining section of the contact leg is pressed against the attachment section of the retaining leg.

7. Electrical connection clamp or terminal clamp as claimed in claim 1, wherein the metal part is connected to a socket or plug part.

8. Electrical connection clamp or terminal clamp as claimed in claim 1, wherein the attachment section of the contact leg is bent such that the attachment section, together with the end of the clamp leg, forms an entry funnel for the electrical conductor which is to be connected.

9. Electrical connection clamp or terminal clamp as claimed in claim 1, wherein the clamp spring and the metal part are located in an insulating housing, the insulating housing having a conductor insertion opening for inserting the electrical conductor to be connected and an actuating opening for insertion of an actuating tool.

10. Electrical connection clamp or terminal clamp as claimed in claim 1, wherein a kink is provided on the clamp leg, the kink being aligned in a direction of spring force of the clamp leg so that a tip of a actuating tool can act on the kink for opening of the clamp spring.

* * * * *